US007712805B2

(12) United States Patent
Klangos

(10) Patent No.: US 7,712,805 B2
(45) Date of Patent: May 11, 2010

(54) SIFTING SHOVEL

(76) Inventor: Charles Klangos, 284 Boylston St., Lowell, MA (US) 01852

( * ) Notice: Subject to any disclaimer, the term of this patent is extended or adjusted under 35 U.S.C. 154(b) by 0 days.

(21) Appl. No.: 11/611,378

(22) Filed: Dec. 15, 2006

(65) Prior Publication Data

US 2008/0143127 A1 Jun. 19, 2008

(51) Int. Cl.
*F24B 15/08* (2006.01)
*A01B 1/02* (2006.01)

(52) U.S. Cl. ..... 294/49; 294/55; 209/419

(58) Field of Classification Search ..... 294/49, 294/54.5, 55; 209/419
See application file for complete search history.

(56) References Cited

U.S. PATENT DOCUMENTS

| | | | | |
|---|---|---|---|---|
| 71,969 | A | 12/1867 | Brooks | |
| 93,336 | A | 8/1869 | Palmer | |
| 219,167 | A | 9/1879 | Lotz | |
| 246,568 | A | 8/1881 | Starin | |
| 379,322 | A | 3/1888 | Murphy | |
| 420,608 | A | 2/1890 | Rowland | |
| 426,719 | A * | 4/1890 | Fleming | 209/419 |
| 507,826 | A | 10/1893 | Miller | |
| 592,583 | A | 10/1897 | Eads | |
| 645,956 | A | 3/1900 | Hyrons | |
| 944,501 | A | 12/1909 | Portnoy | |
| 1,094,161 | A | 4/1914 | Mueller | |
| 1,138,679 | A | 5/1915 | Martin | |
| 1,165,574 | A | 12/1915 | Davidson | |
| 1,217,314 | A | 2/1917 | Johnson | |
| 1,259,333 | A | 3/1918 | Wynne | |
| 1,284,942 | A | 11/1918 | Steindorf | |
| 1,289,916 | A | 12/1918 | Robetaille | |
| 1,306,931 | A | 6/1919 | Thomas | |
| 1,341,874 | A | 6/1920 | Bandini | |
| 1,357,709 | A | 11/1920 | Jacobus | |
| 1,380,832 | A | 6/1921 | Nicholas | |
| 1,398,666 | A | 11/1921 | Beach | |
| 1,409,572 | A * | 3/1922 | Quinn | 209/419 |
| 1,427,523 | A | 8/1922 | Doyle | |
| 1,453,583 | A | 5/1923 | Berman | |
| 1,455,688 | A | 5/1923 | Weickman | |
| 1,554,525 | A | 9/1925 | Ricci | |
| 1,582,293 | A | 4/1926 | Miller | |
| 1,619,266 | A | 3/1927 | Miller | |
| 1,671,800 | A | 5/1928 | Wechsler | |
| 1,675,092 | A | 6/1928 | Cipriano | |
| 1,710,204 | A | 4/1929 | Cipriano | |

(Continued)

*Primary Examiner*—Paul T Chin
(74) *Attorney, Agent, or Firm*—O'Connell Law Firm

(57) ABSTRACT

A sifting shovel for sifting particulate matter from a volume of material comprising a shovel head and a handle with an end fixed to the shovel head. The shovel head has a base plate, a sifting plate disposed in spaced relation relative to the base plate, a first side wall, a second side wall, and a proximal end wall. The sifting plate has a plurality of apertures therein, and the base plate, the sifting plate, and the first and second side walls have distal ends that together define an open mouth of the shovel head. The open mouth can have a minimum opening height greater than a maximum aperture dimension, and the shovel head can have a truncated wedge shape. At least a portion of the handle can be disposed below a longitudinal center of gravity of the sifting shovel, such as by forming a bend in the handle, to enable the sifting shovel to tip automatically.

12 Claims, 4 Drawing Sheets

U.S. PATENT DOCUMENTS

| | | | | |
|---|---|---|---|---|
| 1,762,347 | A | | 6/1930 | Peebles |
| 2,005,416 | A | | 6/1935 | Fisher |
| D120,610 | S | * | 5/1940 | Berge ..... D7/691 |
| 3,851,763 | A | | 12/1974 | Ball |
| 4,305,376 | A | | 12/1981 | Neugent |
| 4,491,357 | A | | 1/1985 | Richards |
| 5,383,696 | A | | 1/1995 | Speier |
| 5,810,407 | A | | 9/1998 | Melendez et al. |
| 5,848,697 | A | | 12/1998 | Eash |
| D510,689 | S | * | 10/2005 | Marley ..... D8/10 |
| 7,047,907 | B1 | * | 5/2006 | Johnston ..... 294/1.3 |

* cited by examiner

SIFTING SHOVEL

FIELD OF THE INVENTION

The present invention relates generally to tools. More particularly, disclosed herein is a sifting shovel for enabling the separation of dust, ash, and the like from unburned embers to permit, for example, the removal of the dust and ash from a furnace, stove, or the like while enabling the return of the unburned embers for the full and efficient consumption thereof.

BACKGROUND OF THE INVENTION

Fireplaces and stoves have been employed as sources of residential and even commercial heating for centuries, and their popularity can be seen to increase in relative proportion to increases in energy prices. It will be appreciated that it is economically advantageous to get the most energy possible from wood, coal, heating pellets, and other forms of burnable fuel. It would be ideal, therefore, to ensure that the burnable fuel is as fully consumed as possible and, conversely, that as little unburned fuel as possible is removed from the fireplace or stove during cleaning and the like. One knowledgeable in the art will also be aware that removing as little unburned fuel as possible is desirable to minimize the volume of waste with which a party must contend.

A number of prior art inventors, such as Brooks in U.S. Pat. No. 71,969, Cipriano in U.S. Pat. No. 1,675,092, Fisher in U.S. Pat. No. 2,005,416, Neugent in U.S. Pat. No. 4,305,376 to Neugent, and Dixon in U.S. Pat. No. 6,658,285, have sought to provide hand tools for enabling the easy, efficient, and safe sifting of materials. To date, however, the proposed solutions of the prior art have been comparatively limited in effectiveness and complex in structure and operation.

For example, many devices of the prior art have disadvantageously removed significant amounts of large coals, embers, and other uncombusted materials from the combustion area thereby leading to unnecessary energy losses. The effectiveness of other prior art constructions has been inhibited by components that inadequately secure heated embers during the removal and transfer of ash from the combustion area to a waste container thereby representing not only a significant fire hazard but also a messy and inefficient arrangement. Still further, certain prior art devices employ moving parts whose function is impaired by individual and repeated heating effects, including thermal expansion and contraction, thereby leading to malfunctioning and premature failure.

In light of the foregoing, it will be appreciated that there is a need in the art for a sifting tool for enabling the safe and efficient sifting of unburned embers from dust, ash, and the like to permit, for example, the removal of the dust and ash from a furnace, stove, or the like while enabling the return of unburned embers to the combustion area for permitting the full and efficient consumption thereof with minimal waste.

SUMMARY OF THE INVENTION

With an appreciation for the state of the art summarized above, the present invention was founded on the basic object of providing an apparatus for safely and efficiently sifting dust and ash and other relative small particles from larger particles, such as incompletely burned embers.

A further object of the invention is to provide a sifting shovel capable of efficiently delivering ash to a waste receptacle while limiting the scattering of dust or ash.

A further object of the invention is to provide a sifting shovel that enables a sifting of particulate matter from incompletely burned embers while inside a combustion chamber of a fireplace, stove, or the like.

A more particular object of embodiments of the invention is to provide sifting shovel of static construction and operation to enable particulate matter to be sifted without impedance that might otherwise derive from thermal deformations of components of the sifting shovel.

A further object of embodiments of the invention is to enable uncombusted coal, wood, fuel pellets, and other solid fuel remnants to remain within a combustion chamber for full combustion thereof.

A related object of embodiments of the invention is to provide a sifting shovel that minimizes the waste that is yielded during cleaning of a combustion chamber.

A further object of embodiments of the invention is to provide a sifting shovel capable of automatically rolling from a shoveling disposition to a discharge disposition to enable a discharge of ash and other retained particulate matter from the shovel.

These and in all likelihood further objects and advantages of the present invention will become obvious not only to one who reviews the present specification and drawings but also to those who have an opportunity to experience an embodiment of the sifting shovel disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the foregoing objects, a basic embodiment of the present invention comprises a sifting shovel for sifting particulate matter from a volume of material. The sifting shovel has a shovel head and a handle with a proximal end fixed to the shovel head. The shovel head can have a base plate, a sifting plate disposed in spaced relation relative to the base plate, a first side wall, a second side wall, and a proximal end wall. The sifting plate can have a plurality of apertures therein, and the base plate, the first and second side walls, and the rear wall can together define a reception volume for retaining a volume of material. Additionally, the base plate, the sifting plate, and the first and second side walls can have distal ends that together define an open mouth of the shovel head. Under such an arrangement, the shovel head can be inserted into a volume of material, material smaller than a given size can be sifted through the apertures and into the reception volume, and material greater than a given size can be prevented from being sifted through the apertures.

The apertures in the sifting plate can be considered to have a maximum aperture dimension, and the open mouth of the sifting shovel can be considered to have a minimum opening height. The minimum opening height can be calibrated to be greater than the maximum aperture dimension, such as by ⅛ inches or more, whereby it can be ensured that material received through the apertures can be emitted through the open mouth. The minimum opening height can be substantially consistent, and the apertures can also be substantially consistent in size and shape. The apertures can pursue any particular shape or combination thereof including, for example, a diamond shape.

In certain constructions, the shovel head can have a height that increases from a distal tip to a proximal end thereof such that the shovel head has a truncated wedge shape. While the pitch of the height change can vary, one embodiment of the sifting shovel can have a shovel head that increases at a pitch of approximately 4.5 degrees. The first and second side walls and the rear wall can be disposed substantially perpendicularly to the base plate and can meet the base plate at inside angles that are radiused to prevent the accumulation of debris. Still further, the base plate can have a beveled tip. The sifting plate can be fixed in relation to the base plate thereby to eliminate any moving parts and the potentially deleterious effects that heat can have thereon.

The sifting shovel can be considered to have a longitudinal center of gravity, and at least a portion of the handle can be disposed below the longitudinal center of gravity when the sifting shovel is disposed with the sifting plate disposed facing upwardly. The handle can be rounded. With this, the portion of the handle disposed below the longitudinal center of gravity can be rested on an outside surface, such as an edge of a refuse container, and the sifting shovel will tend to turn over automatically to dispense any material retained therein. In one embodiment, this can be accomplished by having at least a portion of the handle angled to a sifting plate side of the shovel head, such as by having a bend adjacent to the proximal end thereof.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The sifting shovel disclosed herein is subject to a wide variety of embodiments. However, to ensure that one skilled in the art will be able to understand and practice the present invention, certain preferred embodiments of the broader invention revealed herein are described below and shown in the accompanying drawings and figures.

Before any particular embodiment of the invention is explained in detail, it must be made clear that the following details of construction and illustrations of inventive concepts are mere examples of the many possible manifestations of the invention. While furnaces, stoves, and the like are commonly referenced herein as the structures from which matter is to be removed, it is to be understood that the sifting shovel could be employed relative to numerous other structures and in widely varied applications.

Figure 1:
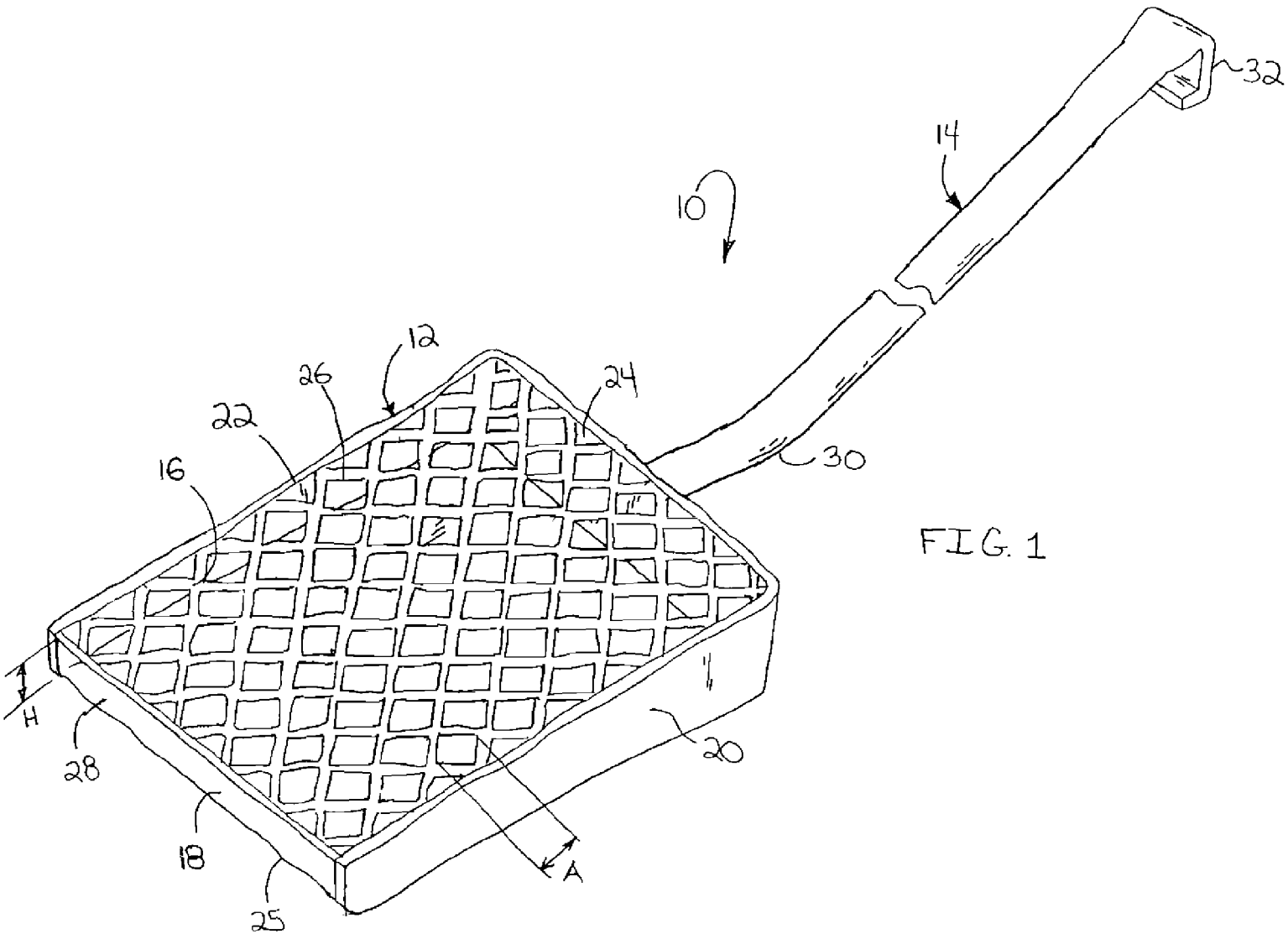
FIG. 1 is a perspective view of a sifting shovel pursuant to the invention disclosed herein.
Figure 2:
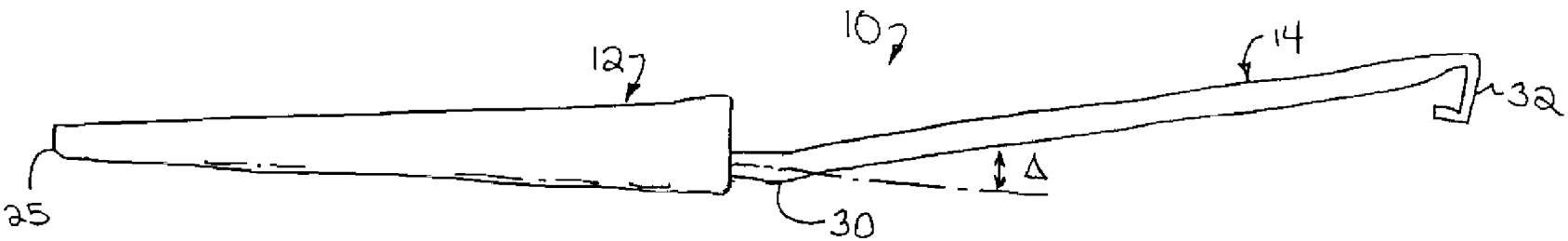
FIG. 2 is a view in side elevation of the sifting shovel of FIG. 1.

Turning more particularly to the drawings, one embodiment of a sifting shovel pursuant to the present invention is indicated generally at 10 in FIGS. 1 and 2. There, the sifting shovel 10 is founded on a shovel head 12. The shovel head 12 has a base plate 18 retained in spaced relation relative to a sifting plate 16 by first and second side walls 20 and 22 and a rear wall 24. Together, the base plate 18 and the first and second side walls 20 and 22 define a reception volume for receiving a volume of material. A proximal end of an elongate handle 14 is fixed to the rear wall 24 of the shovel head 12 to enable control and manipulation sifting shovel 10. The handle 14, which can be a round tube or rod, can be fixed to the shovel head 12 by any effective method, including welding, a threaded connection, mechanical fasteners, a friction fit, integral formation, or any other suitable method. A hook portion 32 can be disposed at a distal end of the handle 14 for enabling manipulation, handling, and storage of the sifting shovel 10.

The shovel head 12 has an open mouth 28 defined by the distal edges of the base plate 18, the first and second side walls 20 and 22, and the sifting plate 16. The open mouth 28 can be considered to have a minimum opening height H. The height H can be substantially consistent. The shovel head 12 can increase in height from the open mouth 28 to the rear wall 24 thereby to cause the shovel head 12 to pursue a truncated wedge shape.

The first and second side walls 20 and 22, the base plate 18, and the sifting plate 16 could comprise separate members coupled in any effective manner, such as by welding, fasteners, or any other suitable method. Alternatively, some or all of the first and second side walls 20 and 22, the base plate 18, and even the sifting plate 16 could be formed integrally, such as from a single panel of material. The first and second side walls 20 and 22 and the rear wall 24 can be disposed at substantially right angles relative to the base plate 18 whereby the sifting shovel 10 can be readily employed for clearing debris from corners in a fireplace, stove, or the like. Also, the inside angles where the first and second side walls 20 and 22 and the rear wall 24 meet the base plate 18 can be radiused, such as to a ¼ inch radius, thereby to prevent the buildup of material within the reception volume. Still further, the base plate 16 can have a beveled tip 25 for enabling a most efficient shoveling of material.

In any case, the first and second side walls 20 and 22, the base plate 18, the sifting plate 16, and the handle 14 could be formed from any suitable material. Of course, based on the likely exposure of the sifting shovel 10 to extremely hot temperatures, the first and second side walls 20 and 22, the base plate 18, the sifting plate 16, and the handle 14 will preferably be formed from a heat resistant material, such as stainless steel.

The sifting plate 16 has a plurality of apertures 26 therein for enabling the passage of material through the sifting plate 16 and into the reception volume defined by the first and second side walls 20 and 22 and the base plate 18. The apertures 26 can be of substantially any shape and can vary in size, and the apertures 26 can be substantially the same or differently sized and shaped. In the depicted embodiment, the apertures 26 are diamond shaped and are substantially identical in shape and disposition over the sifting plate 16.

The apertures 26 can have a maximum aperture dimension A. The minimum opening height H can be calibrated to be a given amount greater than the maximum aperture dimension A. In one example, the minimum opening height H could be ⅜ inches while the maximum aperture dimension A could be ¼ inch such that the minimum opening height H would be ⅛ inches larger than the maximum aperture dimension A. The shovel head 12 can have a maximum height at the rear wall 24 of, for example, 1 inch, a length of approximately 5 inches, and a width of approximately 4 inches. The handle 14 can in certain examples of the invention have a length of, for example, 30 inches. While the invention is not so limited, it has been found to be advantageous to have the shovel head 12 increase in height at a pitch of roughly 4.5 degrees.

Under such an arrangement, a user can insert the wedge-shaped shovel head 12 of the sifting shovel 10 into a volume of material to be sifted, such as a mixture of dust, ash, and incompletely combusted embers. Dust, ash, and particles smaller than the open mouth 28 and the apertures 26 can pass respectively therethrough to be received into the reception volume defined by the base plate 16, the side walls 20 and 22, and the rear wall 24. Where the material is shoveled onto the sifting plate 18, embers larger than the apertures 26 will be prevented from entering the reception volume such that they will remain atop the sifting plate. Those embers can thus be safely and effectively returned to the combustion area by shaking or tilting the shovel head 12.

With this, one can effectively remove dust and ash from a fireplace, stove, or the like while avoiding the removal of incompletely burned materials and the waste and disposal issues associated therewith. By having the minimum opening height H of the open mouth 28 be greater than the maximum aperture dimension A of the apertures 26, one can ensure that particulate matter that is received through the apertures 26 can be dispensed through the open mouth 28. With this, buildup of debris within the reception volume is advantageously avoided.

As one can perceive from FIGS. 1 and 2, at least a portion of the handle 14 can be disposed at an angle in relation to the shovel head 12. More particularly, the handle 14 can be angled to the sifting plate 18 side of the shovel head 12, such as by having a bend 30 at a proximal portion of the handle 14. Such a disposition of the handle 14 in relation to the shovel head 12 allows the sifting shovel 10 to be manipulated most effectively. Additionally, with such a bend 30 along the handle 14, at least the outside of the bend 30 will be disposed eccentrically to the longitudinal center of gravity of the sifting shovel 10.

It has been found that, when the end 30 or a portion of the handle 14 adjacent thereto is disposed on an external structure, such as on the lip of a refuse container, with the sifting shovel 10 in an upright condition, namely with the sifting plate 18 facing upwardly, the sifting shovel 10 will automatically flip over thereby to cause the material retained in the reception volume to be dispensed. An angle Δ of approximately 11 and ½ degrees has been determined to be effective for accomplishing an automatic flipping of the sifting shovel 10 while not prejudicing the operation thereof.

Of course, means aside from a bend 30 for establishing a pivot surface eccentric to the longitudinal axis of the sifting shovel 10 would be readily obvious after reading this disclosure. For example, an automatic rotation of the sifting shovel 10 can be facilitated as is also shown in relation to the sifting shovel 10 of FIGS. 1 and 2 by having the handle 14 coupled to the rear wall 24 of the shovel head 12 below the longitudinal center of gravity of the shovel head 12. With this, even where the handle 14 is essentially straight and in line with the longitudinal axis of the shovel head 12 as in FIG. 3, the sifting shovel 10 will tend to pivot automatically upon the resting of the handle 14 on a support surface.

Figure 3:
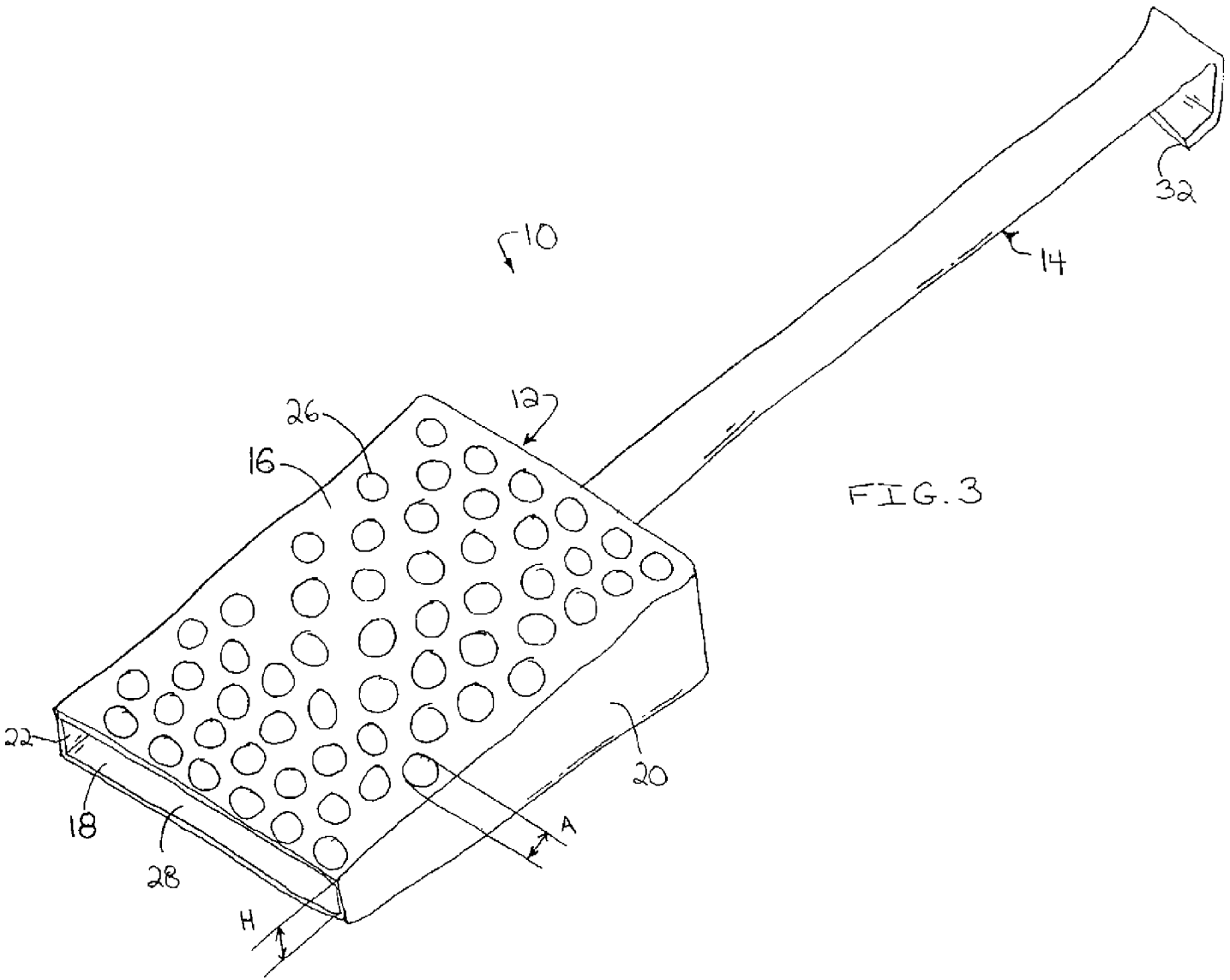
FIG. 3 is a perspective view of an alternative embodiment of the sifting shovel of the present invention.
Figure 4:
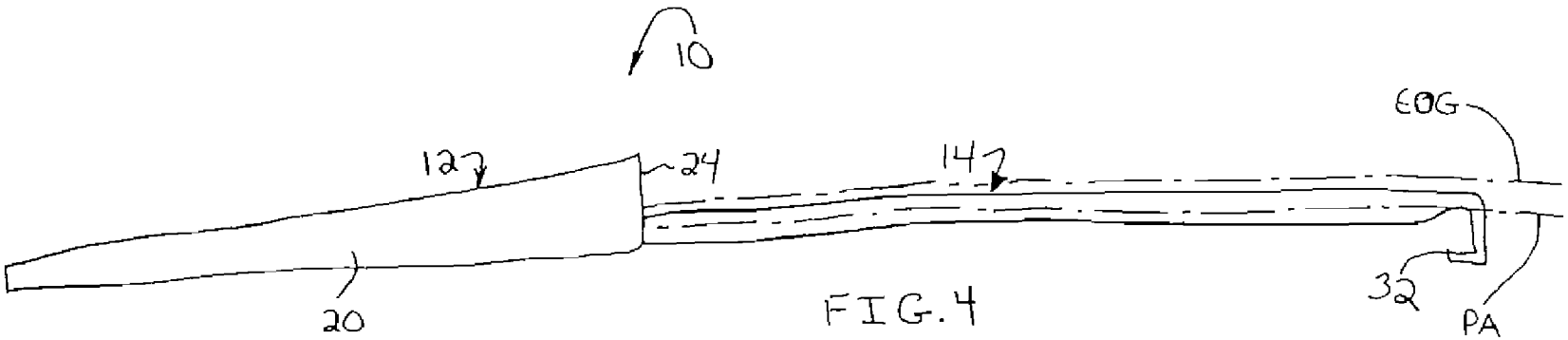
FIG. 4 is a view in side elevation of the sifting shovel of FIG. 3.

An alternative construction of a sifting shovel 10 pursuant to the instant invention is depicted in FIGS. 3 and 4. There, the sifting shovel 10 again has a shovel head 12. The shovel head 12 has a base plate 28 with first and second side walls 20 and 22 and a rear wall 24 perpendicularly fixed thereto to define a reception volume. A sifting plate 18 is fixed to the upper edges of the first and second side walls 20 and 22 and the rear wall 24 in spaced relation relative to the base plate 16. The sifting plate 18 could be in a plane parallel to a plane of the base plate 16, or, as is shown in FIGS. 3 and 4, the sifting plate 18 and the base plate 16 can be disposed in a truncated wedge configuration with the separation between the sifting plate 18 and the base plate 16 increasing from the distal to proximal ends of the shovel head 12.

An elongate handle 14, which can be round, with a hook portion 32 again has a proximal end fixed to the rear wall 24 of the shovel head 12. Furthermore, a plurality of apertures 26 are disposed in the sifting plate 18 for enabling ash, dust, and sufficiently small debris to sift therethrough and into the reception volume for being removed from the combustion area. The distal ends of the sifting plate 18, the base plate 16, and the first and second side walls 20 and 22 again together define an open mouth 28 of the shovel head 12. The open mouth 28 can again have a minimum opening height H greater than the maximum aperture dimension A thereby to ensure that debris being received into the reception volume, whether through the open mouth 28 or through the apertures 26, can be dispensed through the open mouth 28.

In the present embodiment, however, the apertures 26 are substantially round in configuration and are substantially consistent in size. With this, the maximum aperture dimension A is defined by the aperture diameter. The construction of FIGS. 3 and 4 also varies in that the handle 14 does not have a bend therein but instead extends along a centerline that establishes a pivot axis PA that is generally parallel to, but below, a longitudinal center of gravity COG of the sifting shovel 10 as a whole. Under this arrangement, the lower portion of the handle 14 can be rested on a support surface, such as the rim of a refuse container (not shown), and, due to the pivot axis PA being below the longitudinal center of gravity COG of the sifting shovel, gravity will tend to induce an automatic flipping of the sifting shovel 10 with a concomitant discharge of any ash, dust, or other material retained therein.

With certain details and embodiments of the present invention for a sifting shovel disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with the major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims express certain elements as means for performing a specific function, at times without the recital of structure or material. As the law demands, these claims shall be construed to cover not only the corresponding structure and material expressly described in this specification but also all equivalents thereof whether now known or hereafter discovered.

I claim as deserving the protection of Letters Patent:

1. A sifting shovel for sifting particulate matter from a volume of material, the sifting shovel comprising:

a shovel head with a base plate, a sifting plate fixed in relation to the base plate, a first side wall, a second side wall, and a proximal end wall wherein the sifting plate has a plurality of apertures therein, wherein the base plate, the first and second side walls, and the rear wall together define a reception volume for retaining a volume of material, wherein the base plate, the sifting plate, and the first and second side walls have distal ends that together define an open mouth of the shovel head; and an elongate handle with a proximal end fixed to the shovel head for enabling control and manipulation of the sifting shovel wherein the handle has a substantially round cross section, a bend adjacent to the proximal end of the handle, and a substantially straight portion from the bend to adjacent to a distal end of the handle, and wherein the bend angles the substantially straight portion of the handle to a sifting plate side of the shovel head;

whereby the shovel head can be inserted into a volume of material, material smaller than a given size can be sifted through the apertures and into the reception volume, and material greater than a given size can be prevented from being sifted through the apertures.

2. The sifting shovel of claim 1 wherein the apertures have a maximum aperture dimension, wherein the open mouth of the sifting shovel has a minimum opening height, and wherein the minimum opening height is greater than the maximum aperture dimension.

3. The sifting shovel of claim 2 wherein the minimum opening height is at least ⅛ inches larger than the maximum aperture dimension.

4. The sifting shovel of claim 2 wherein the minimum opening height is substantially consistent.

5. The sifting shovel of claim 2 wherein the apertures are substantially consistent in size and shape.

6. The sifting shovel of claim 5 wherein the apertures are diamond shaped.

7. The sifting shovel of claim 1 wherein the shovel head has a height that increases from a distal tip of the shovel head to a proximal end of the shovel head whereby the shovel head has a truncated wedge shape.

8. The sifting shovel of claim 7 wherein the height of the shovel head increases at a pitch of approximately 4.5 degrees.

9. The sifting shovel of claim 1 wherein the first and second side walls and the rear wall are disposed substantially perpendicularly to the base plate.

10. The sifting shovel of claim 9 wherein the first and second side walls and the rear wall meet the base plate at inside angles that are radiused.

11. The sifting shovel of claim 1 wherein the base plate has a beveled tip.

12. The sifting shovel of claim 1 wherein the handle is angled in relation to the shovel head at an angle of approximately 11.5 degrees.

* * * * *